US010791823B2

(12) United States Patent
Lee et al.

(10) Patent No.: US 10,791,823 B2
(45) Date of Patent: Oct. 6, 2020

(54) BOTTLE BRUSH

(71) Applicant: Munchkin, Inc., Van Nuys, CA (US)

(72) Inventors: Agnes Yena Lee, Los Angeles, CA (US); Sung Yun Chan, Pasadena, CA (US)

(73) Assignee: Munchkin, Inc., Van Nuys, CA (US)

( * ) Notice: Subject to any disclaimer, the term of this patent is extended or adjusted under 35 U.S.C. 154(b) by 185 days.

(21) Appl. No.: 15/904,264

(22) Filed: Feb. 23, 2018

(65) Prior Publication Data

US 2018/0235354 A1 Aug. 23, 2018

Related U.S. Application Data

(60) Provisional application No. 62/462,876, filed on Feb. 23, 2017.

(51) Int. Cl.
*A46B 5/00* (2006.01)
*A46B 15/00* (2006.01)

(52) U.S. Cl.
CPC ..... *A46B 5/0095* (2013.01); *A46B 15/0097* (2013.01); *A46B 2200/3006* (2013.01)

(58) Field of Classification Search
CPC . A46B 2200/3006; A46B 9/06; A46B 5/0016; A46B 15/0097; A46B 2200/3033; B25G 1/08
See application file for complete search history.

(56) References Cited

U.S. PATENT DOCUMENTS

| | | | | |
|---|---|---|---|---|
| 1,142,698 | A * | 6/1915 | Grove | A46B 9/005 15/117 |
| 9,167,882 | B2 * | 10/2015 | Stefanson | A61C 15/00 |
| 2006/0026784 | A1 * | 2/2006 | Moskovich | A46B 5/007 15/110 |
| 2007/0143945 | A1 * | 6/2007 | DiPietro | A46B 5/02 15/188 |
| 2016/0296003 | A1 * | 10/2016 | Beckerman | A46B 5/002 |

FOREIGN PATENT DOCUMENTS

KR 200447964 3/2010

OTHER PUBLICATIONS

International Search Report, Search History, and Written Opinion for PCT/US18/19585, dated May 31, 2018. p. 1-12.
https://www.amazon.com/Munchkin-Miracle-Sided-Bottle-Brush/dp/B07894VBHP. p. 1-7.
https://www.toysrus.com/buy/accessories/munchkin-latch-deluxe-valve-brush-43555-32647686. p. 1-3.

* cited by examiner

*Primary Examiner* — Shay Karls
(74) *Attorney, Agent, or Firm* — Robert Z. Evora, Esq.

(57) ABSTRACT

A brush assembly is disclosed having a brush handle with a variety of vertical and horizontal bristles positioned thereon, as well as middle paddles. The handle fits upon a resting base which may be a suction cup and adapted to collect water which flows down from the bristles and the handle into a collection area, and further directed down a ramp which directs fluid off of the resting base.

16 Claims, 4 Drawing Sheets

BOTTLE BRUSH

CROSS REFERENCE TO RELATED APPLICATIONS

This application claims priority to U.S. Provisional Patent Application Ser. No. 62/462,876, filed Feb. 23, 2017; the content of which is hereby incorporated by reference herein in its entirety into this disclosure.

TECHNICAL FIELD

The subject disclosure relates generally to the field of brushes. In particular, the subject disclosure relates to multi-function bottle brushes.

BACKGROUND

The importance of proper hygiene when handling and cleaning infant feeding tools, such as baby bottles, and nursing nipples cannot be overstated. Ideally, bottles and nipples should be thoroughly scrubbed. Proper scrubbing is especially important after a nipple or bottle has been used to dispense fatty liquids, or liquids having suspended solids therein, such as cereal. Removing food from tight corners and difficult contours in a bottle can be quite challenging. Although various solutions have been proposed, none available has effectively solved the issue of thoroughly cleaning the various contours of a container and/or other items to be cleaned.

SUMMARY OF THE SUBJECT DISCLOSURE

The present subject disclosure presents a simplified summary of the subject disclosure in order to provide a basic understanding of some aspects thereof. This summary is not an extensive overview of the various embodiments of the subject disclosure. It is intended to neither identify key or critical elements of the subject disclosure nor delineate any scope thereof. The sole purpose of the subject summary is to present some concepts in a simplified form as a prelude to the more detailed description that is presented hereinafter.

In one exemplary embodiment, the present subject disclosure is a brush assembly. The brush assembly includes a brush having a set of bristles; a base; an elongated handle having two ends and connected to the brush at a first end and the base at a second end; and a paddle positioned within the set of bristles.

In another exemplary embodiment, the present subject disclosure is a brush assembly. The brush assembly includes a brush having a set of bristles; a base portion; an elongated substantially hollow handle having two ends and connected to the brush at a first end and removably connected to the base portion at a second end; and a paddle positioned within the set of bristles, wherein the paddle is shorter in length than the set of bristles.

In yet another exemplary embodiment, the present subject disclosure is brush assembly. The brush assembly includes a brush having a set of includes vertical and horizontal oriented bristles; a base portion having a straw brush; an elongated substantially hollow handle having two ends and connected to the brush at a first end and removably connected to the base portion at a second end; and a paddle positioned within the set of bristles, wherein the paddle is shorter in length than the set of bristles.

While various aspects, features, or advantages of the subject disclosure are illustrated in reference bottle brush assemblies, such aspects and features also can be exploited in various other configurations.

To the accomplishment of the foregoing and related ends, the subject disclosure, then, comprises the features hereinafter fully described. The following description and the annexed drawings set forth in detail certain illustrative aspects of one or more embodiments of the disclosure. However, these aspects are indicative of but a few of the various ways in which the principles of the subject disclosure may be employed. Other aspects, advantages and novel features of the subject disclosure will become apparent from the following detailed description of various example embodiments of the subject disclosure when considered in conjunction with the drawings.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Particular embodiments of the present subject disclosure will now be described in greater detail with reference to the figures.

Figures 1A, 1B, 1C:
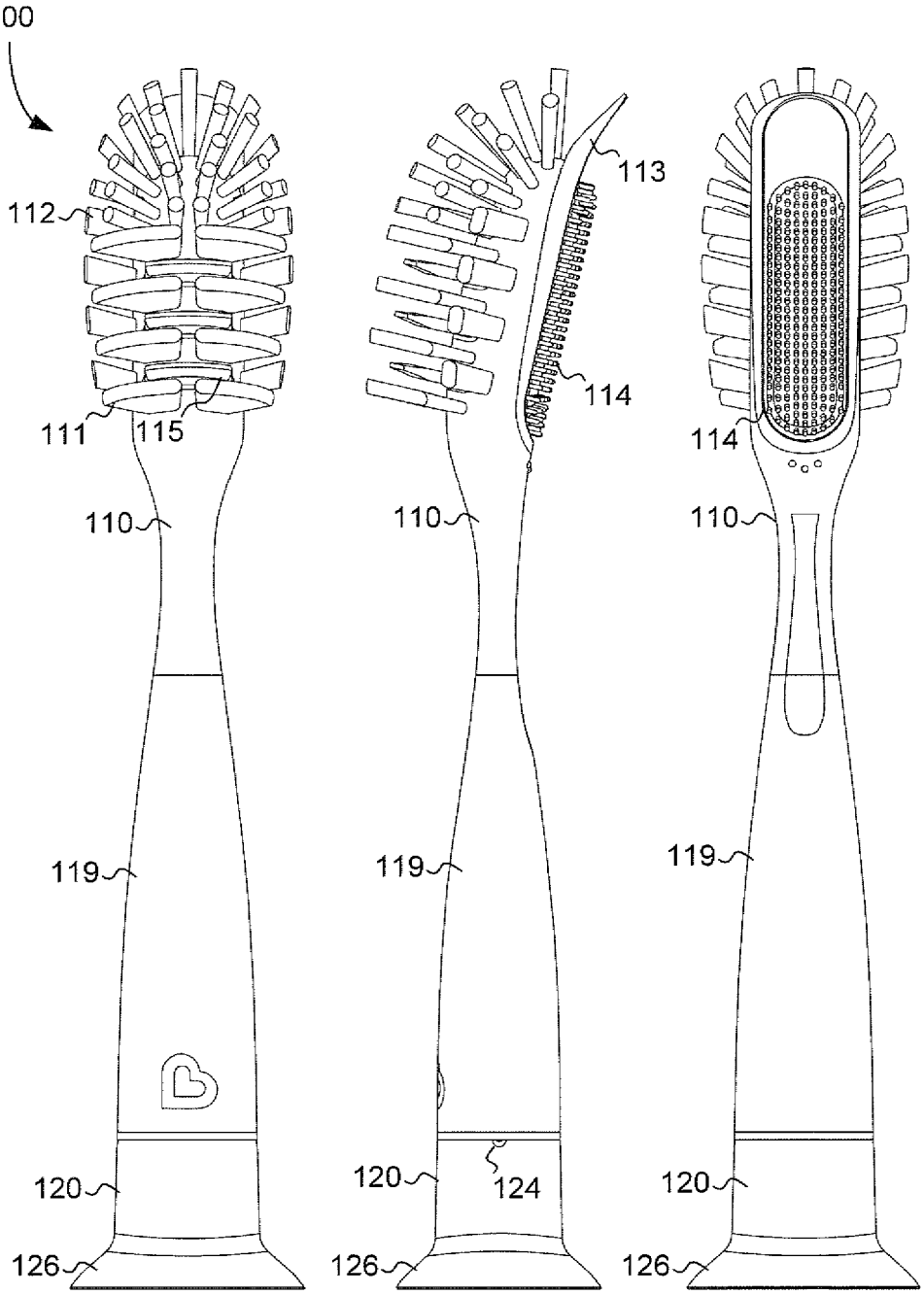
FIGS. 1A-1C illustrate front, side, and back views of a bottle brush, according to an exemplary embodiment of the present subject disclosure.

As shown in FIG. 1, an exemplary embodiment of the present subject disclosure is a bottle brush assembly 100 having a brush 110, handle 119 and a base 120 which serves as the docking base for the brush handle 119. As illustrated in the figures, the exemplary brush 110 has a series of bristles, which are positioned both horizontally 111 and vertically 112 to allow for side-to-side as well as up and down cleaning motions. The bristles 111, 112 are positioned about one or more middle paddles 115 which help scrub and retain soap or other detergents. In the exemplary embodiments, three middle paddles 115 are shown, but any number is possible and within the scope of the present disclosure.

Figure 3A:
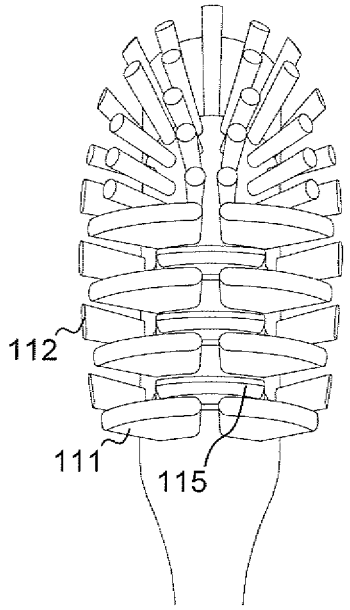
FIGS. 3A-3B show a more detailed view of the front and back sides of the bristle component of a bottle brush, according to an exemplary embodiment of the present subject disclosure.
Figure 3B:
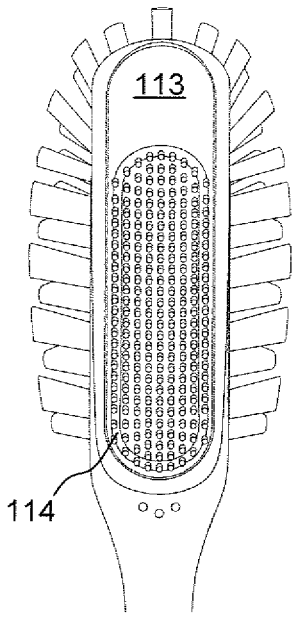

The front side of the brush 110 contains the horizontal 111, vertical 112 bristles and middle paddles 115. The back of the large surface brush 110 includes an edge brush 113 which is positioned at an angle and used to reach places that a normal bristle would not be able to reach. Just lower than the edge brush 113 is a small surface brush 114 which contains soft and short bristles which are more suitable for controlled cleaning with minimal splashing, such as for cleaning the threads on a cup. FIGS. 3A-3B provide a more detailed view of the bristles on the front (FIG. 3A) and back (FIG. 3B) sides of the brush 110.

The brush 110 is connected to an elongated handle 119 which rests upon a separate base 120. The base 120 is modular and can be interchanged with other bases with different functions. The base 120 is shown with built in suction cup 126 throughout the examples, but it can also be a standard flat base without a suction cup design.

Figure 2:
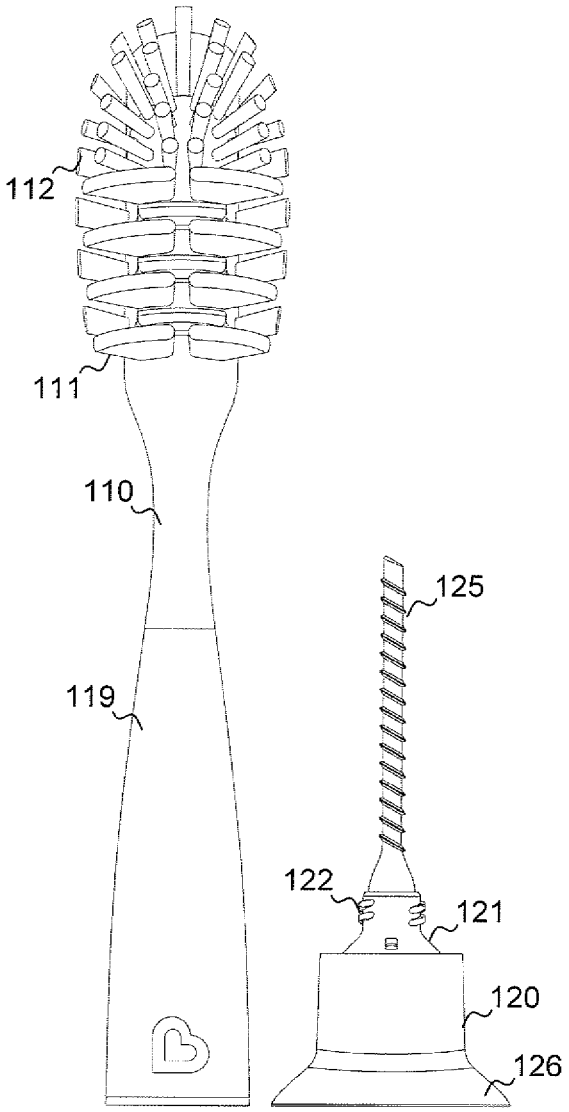
FIG. 2 illustrate a removable base portion of a bottle brush, according to an exemplary embodiment of the present subject disclosure.

FIG. 2 shows the elongated handle 119 separated from the base 120. The base 120 has an elongated central brush 125 which can be used as a straw brush, to accommodate standard toddler cup straws or other cleaning areas which need a narrow brush. The straw brush 125 has a small pointed/slanted edge to allow access into small crevices. An angled intermediary section 121 is designed to create a fit seal when the base 120 is attached to the elongated handle 110. Built in threads 122 allow a short screwing in motion of the base 120 into the elongated handle 110.

Figure 4A:
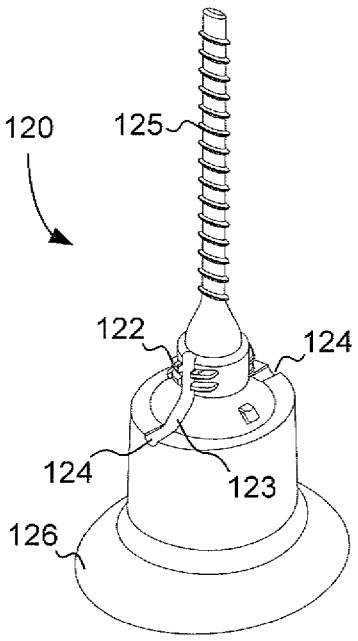
FIGS. 4A-4B show a more detailed view of various base options of a bottle brush, according to an exemplary embodiment of the present subject disclosure.
Figure 4B:
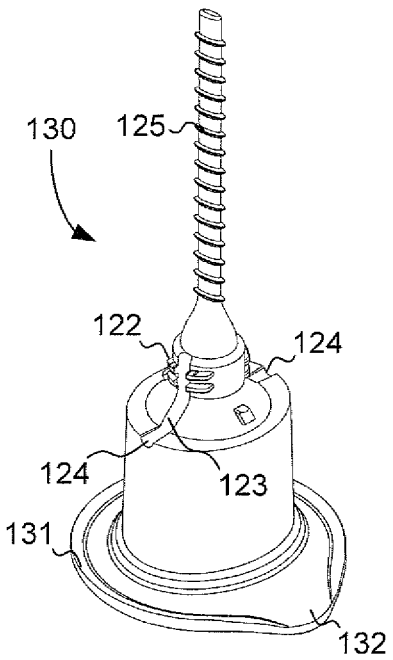

FIGS. 4A-4B show two exemplary base portion embodiments which may be connected to the elongated handle 119. Both embodiments have built in threads 122 to use when attaching to the elongated handle 119. They both also have drain channels 123 which direct any fluid on the body of the central brush 125 away from the base through one or more apertures 124.

The differences between base 120 and base 130 is in the portion that attaches to a surface. Base 120 (shown in FIG. 4A) has a suction cup 126 which serves to provide a firm connection between the base 120 and a surface. This would be helpful to maintain the brush assembly 100 upright as it may be prone to falling due to its height.

Base 130 (shown in FIG. 4B) may also have a suction cup on its bottom, but has a design which allows it to collect and direct fluid in a given path, thereby reducing watermarks and the other hazards associated with collecting soiled or dirty water. The base 130 is designed so that fluid flows off of the brush 110 or central brush 125 and onto the base 130 which collects water in a valley or moat 131 and redirects the fluid to a downward sloping ramp 132 on the bottom portion of the base 130. The base 130 may be placed on a counter to direct water to a wash basin sink, for example.

The base 130 allows fluid to drip off the bristles of the brush assembly 110 and run down along the handle 119 of the brush to collect into the small moat 131 in the base 130, which then directs the fluid out of the moat 131 downward through the fluid ramp 132 opening. This configuration assures that there is no fluid buildup at the base 130 of the brush assembly 100 and that fluid is easily directed away from the base 130 to prevent water stains and other damage near the base 130 of the brush assembly 100.

FIGS. 5A-5D show exemplary ways of using the various brushes on the bottle brush 100 to clean various objects. These are examples only and are not limiting of the scope of the use of the present subject disclosure. Many other uses are evident to one having ordinary skill in the art after consideration of the present disclosure.

Figure 5A:
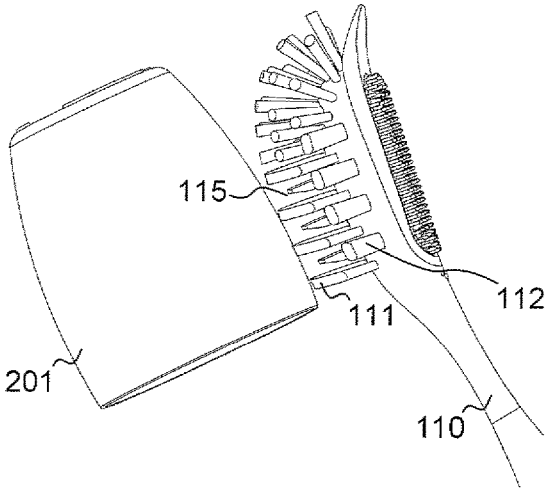
FIGS. 5A-5D show the various brushes of the bottle brush being used I different environments, according to an exemplary embodiment of the present subject disclosure.

In the example shown in FIG. 5A, a surface of a cup 201 is washed with the horizontal bristles 111 and vertical bristles 112 of the large surface brush 110. Up and down as well as side to side motions are easily accomplished using the combination of the horizontal 111 and vertical bristles 112. Further, the middle paddles 115 help scrub and retain soap during the cleaning process.

Figure 5B:
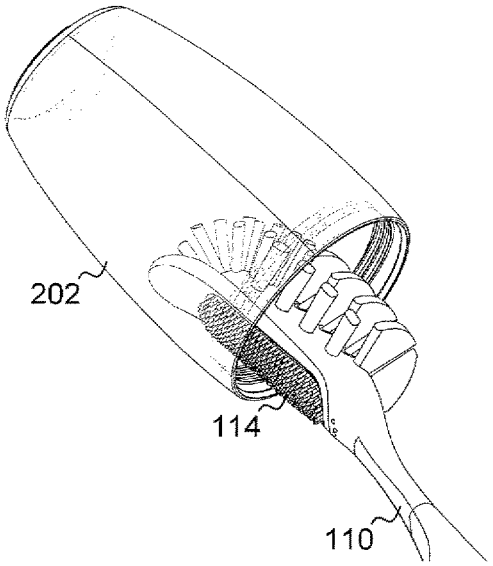

In the example shown in FIG. 5B, threads within the interior of a cup 202 are washed with the small surface brush 114, which typically has softer and shorter bristles for more control of the water (and less splashing).

Figure 5C:
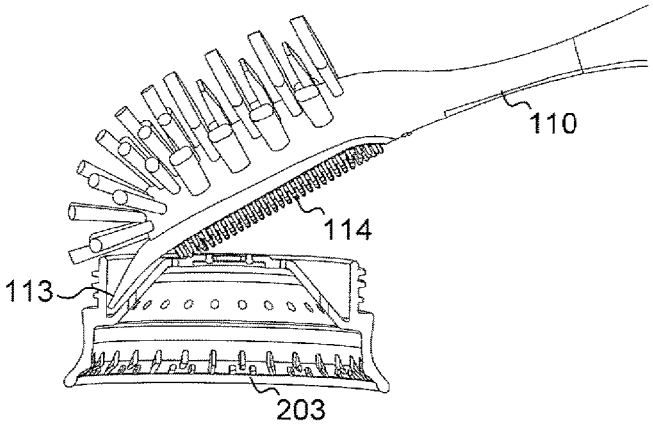

In the example shown in FIG. 5C, the edge brush 113 is used for hard to reach corners of this cup 113. The edge brush 113 may also be used to clean the far bottom corners of a bottle. The small surface brush 114 may also help to a lesser degree because of its proximity to the edge brush 113.

Figure 5D:
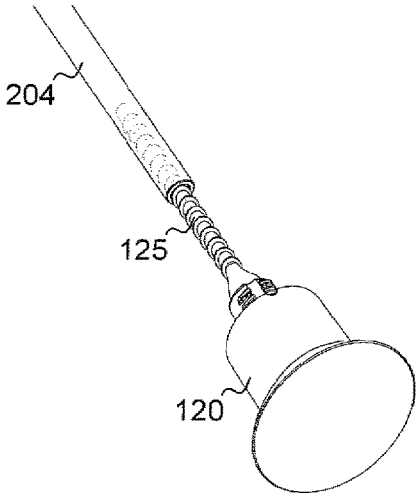

In the example shown in FIG. 5D, the straw brush 125 is used to clean the interior of various reusable straws, such as for sippy cups or other toddler cups. The straw brush may also be used for other small crevices.

As employed in this specification and annexed drawings, the term "or" is intended to mean an inclusive "or" rather than an exclusive "or." Moreover, articles "a" and "an" as used in the subject specification and annexed drawings should generally be construed to mean "one or more" unless specified otherwise or clear from context to be directed to a singular form.

What has been described above includes examples that provide advantages of the subject disclosure. It is, of course, not possible to describe every conceivable combination of components or methodologies for purposes of describing the subject disclosure, but one of ordinary skill in the art may recognize that many further combinations and permutations of the claimed subject matter are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

The illustrations and examples provided herein are for explanatory purposes and are not intended to limit the scope of the appended claims. It will be recognized by those skilled in the art that changes or modifications may be made to the above described embodiment without departing from the broad inventive concepts of the subject disclosure. It is understood therefore that the subject disclosure is not limited to the particular embodiment which is described, but is intended to cover all modifications and changes within the scope and spirit of the subject disclosure.

What is claimed is:

1. A brush assembly, comprising:

a brush body having a set of longer bristles extending from a first side and a second set of softer and shorter bristles extending from a second side;

an edge brush extending above the first and second side from the brush body to form a sharp upper peripheral edge;

a base;

an elongated handle having two ends and connected to the brush body at a first end and the base at a second end; and a paddle positioned within the set of bristles.

2. The brush assembly of claim 1, wherein the base includes a suction cup.

3. The brush assembly of claim 1, Therein the base is removable from the elongated handle.

4. The brush assembly of claim 1, wherein the base is screwed into the elongated handle.

5. The brush assembly of claim 1, wherein base further includes a straw brush.

6. The brush assembly of claim 5, wherein the straw brush is positioned within a hollow interior of the handle when the base is connected to the elongated handle.

7. The brush assembly of claim 1, wherein the base has a fluid collection area.

8. The brush assembly of claim 7, wherein the base includes a ramp to direct fluid in a direction away from the base.

9. The brush assembly of claim 7, wherein the base includes a channel to direct fluid out from within an interior of the handle through an aperture.

10. The brush assembly of claim 1, wherein the set of bristles includes vertical and horizontal oriented bristles.

11. The brush assembly of claim 1, wherein the paddle is shorter in length than the set of bristles.

12. The brush assembly of claim 1, wherein the pa comprises a series of paddles in parallel.

13. A brush assembly; comprising:

a brush body having a set of longer bristles extending from a first side and a second set of softer and shorter bristles extending from a second side;

an edge brush extending above the first and second side from the brush body to form a sharp uppermost peripheral edge;

a base portion;

an elongated substantially hollow handle having two ends and connected to the brush body a first end and removably connected to the base portion at a second end; and a paddle positioned within the set of bristles, wherein the paddle is shorter in length than the set of bristles.

14. The brush assembly of claim 13, wherein the base further includes a straw brush which is housed within the hollow handle.

15. The brush assembly of claim 13, wherein the set of bristles includes vertical and horizontal oriented bristles.

16. A brush assembly, comprising:

a brush body having a set of longer bristles extending from a first side that includes vertical and horizontal oriented bristles and a second set of softer and shorter bristles extending from a second side;

an edge brush extending above the first and second side from the brush body to form a sharp uppermost peripheral edge;

a base portion having a straw brush;

an elongated substantially hollow handle having two ends and connected to the brush body at a first end and removably connected to the base portion at a second end; and a paddle positioned within the set of bristles; wherein the paddle is shorter in length than the set of bristles.

* * * * *